United States Patent [19]

Snyder, Jr.

[11] 3,979,209

[45] Sept. 7, 1976

[54] DUCTILE TUNGSTEN-NICKEL ALLOY AND METHOD FOR MAKING SAME

[75] Inventor: William B. Snyder, Jr., Knoxville, Tenn.

[73] Assignee: The United States of America as represented by the United States Energy Research and Development Administration, Washington, D.C.

[22] Filed: Feb. 18, 1975

[21] Appl. No.: 550,677

[52] U.S. Cl. ..... 75/227; 75/224; 29/182

[51] Int. Cl.[2] ..... B22F 1/00; B22F 1/02

[58] Field of Search ..... 75/224, 227, 176; 29/182; 148/126

[56] References Cited

UNITED STATES PATENTS

| | | | |
|---|---|---|---|
| 3,037,982 | 3/1967 | Milligan et al. | 75/176 |
| 3,116,146 | 12/1963 | Gatti | 29/182 |
| 3,175,903 | 3/1965 | Herron | 29/182 |
| 3,241,955 | 3/1966 | Neeley | 75/176 |
| 3,359,082 | 12/1967 | Dickinson | 29/182 |
| 3,395,013 | 7/1968 | Friedman | 75/176 |
| 3,888,636 | 6/1975 | Sczerzenic et al. | 75/176 |

*Primary Examiner*—Benjamin Padgett
*Assistant Examiner*—Josephine Lloyd
*Attorney, Agent, or Firm*—Dean E. Carlson; David S. Zachry; Earl L. Larcher

[57] ABSTRACT

The present invention is directed to a ductile, high-density tungsten-nickel alloy which possesses a tensile strength in the range of 100,000 to 140,000 psi and a tensile elongation of 3.1 to 16.5 percent in 1 inch at 25°C. This alloy is prepared by the steps of liquid phase sintering a mixture of tungsten-0.5 to 10.0 weight percent nickel, heat treating the alloy at a temperature above the ordering temperature of approximately 970°C. to stabilize the matrix phase, and thereafter rapidly quenching the alloy in a suitable liquid to maintain the matrix phase in a metastable, face-centered cubic, solid- solution of tungsten in nickel.

3 Claims, No Drawings

DUCTILE TUNGSTEN-NICKEL ALLOY AND METHOD FOR MAKING SAME

The present invention relates to a high-density tungsten-nickel alloy, and more particularly to the preparation of such an alloy by employing liquid phase sintering and a heat treating step above the ordering temperature followed by a rapid quench. This invention was made in the course of, or under, a contract with the United States Atomic Energy Commission.

High density tungsten-nickel alloys have been employed in various applications where the high density and strength of the alloys are used advantageously, such as in counterbalances, gyroscopes, radiation shields, and the like. These alloys have been prepared by mixing suitable forms of tungsten and nickel, such as tungstic acid and a nickel salt, e.g., $NiCl_2$, reducing the mixture in hydrogen, pressing the resulting powder into the desired article configuration, and then sintering the compact in a hydrogen or a dissociated ammonium atmosphere. Alternatively, elemental tungsten and nickel powders may be blended prior to the pressing and sintering steps.

One of the shortcomings or drawbacks to the use of articles or structures formed of tungsten-nickel alloys at room temperature, i.e., about 25°C., is the lack of ductility. In fact, these alloys have proven to be very brittle at such low temperatures so as to inhibit their use in many applications where the alloys could be advantageously employed. Efforts to increase the ductility of the tungsten-nickel alloys include the addition of other metals such as iron and copper to the alloy. However, while the low temperature ductility is increased such additions also have an effect of decreasing the density and significantly detracting from the overall strength of the alloy. For example, the addition of iron to the tungsten-nickel binary system decreased the amount of matrix phase as illustrated by comparing the volume percent of matrix in the ternary alloy with the binary alloy. A tungsten-0.58 weight percent nickel-1.17 weight percent iron alloy has 3.55 volume percent matrix whereas the binary alloy composed of tungsten-1.75 weight percent nickel contains 4.97 volume percent matrix. The decrease in matrix accounts in part for the reduction in tensile elongation of the ternary alloys containing large amounts of tungsten. When the matrix content of the alloy system is increased from 5 to 10 weight percent, porosity becomes a problem.

Accordingly, it is the principal aim or primary objective of the present invention to overcome the above and other drawbacks and shortcomings by providing a binary tungsten-nickel alloy which is characterized by a density in the range of about 17.30 to 18.84 g/cc, a tensile strength of at least about 100,000 psi, and a tensile elongation in the range of 3.1 to 16.5 percent in 1 inch at 25°C. The alloy is formed of a mixture of tungsten with about 0.5 to about 10 weight percent nickel which is subjected to a liquid phase sintering step followed by a heat treatment step above the ordering temperature of about 970°C. to stabilize the matrix and then a rapid quench so as to provide a matrix phase in a metastable, face-centered cubic, solid solution of tungsten in nickel with little or no concentration of the alloy embrittling intermetallic phase $WNi_4$.

Other and further objects of the invention will be obvious upon an understanding of the illustrative method and article about to be described, or will be indicated in the appended claims, and various advantages not referred to herein will occur to one skilled in the art upon employment of the invention in practice.

Described generally, the binary tungsten-nickel alloy of the present invention consists essentially of about 0.5 to about 10 weight percent nickel and the balance tungsten. The alloy when sintered into the desired configuration, as will be described in detail below, produces an article having a density in the range of 17.30 to 18.84 g/cc, a tensile strength in the range of about 100,000 to 140,000 psi, and a tensile elongation in the range of 3.1 to 16.5 percent in 1 inch at 25°C. The alloy is characterized by a matrix of a solid solution of tungsten in nickel defining a metastable, face-centered cubic, crystal structure.

Articles of the subject alloy are satisfactorily prepared by blending elemental tungsten powder and an appropriate quantity of nickel powder in a size range of about 3.0 to 25.0 microns and 4.0 to 11.0 microns, respectively. The powder mixture after completing suitable screening and dry blending steps is loaded into rubber bags, which may or may not contain a mandrel, depending on the desired article of configuration. The bags are then evacuated to remove residual gases and the powder mixture is then isostatically pressed at room temperature at a pressure in the range of about 20,000 to 40,000 psi. After removal of the bag and mandrel, the resulting compacts are placed in a sintering fixture formed of high purity alumina or another satisfactory refractory material and then liquid-phase sintered in a hydrogen atmosphere for a duration of 1 to 3 hours. The sintering cycle preferably utilizes a holding period at a temperature less than the sintering temperature for reducing the oxides of the tungsten and nickel and then increasing the temperature to the sintering temperature necessary to effect liquid phase sintering which in the case of the tungsten-nickel powder composition of the present invention is between 1510° to about 1530°C.

It has been found that in order to obtain the desired ductility or tensile elongation at about 25°C., or room temperature, it is necessary to form a solid solution of tungsten in nickel and maintain the crystal structure upon returning the sintered alloy to room temperature. This goal is achieved by employing liquid phase sintering above 1510°C. The alloy comprises essentially pure tungsten surrounded by a liquid containing 45 to 47 percent tungsten. Upon cooling the alloy below the eutectic temperature, it is formed of pure tungsten and a eutectic mixture consisting of nickel solid solution and a very small amount of tungsten. However, if cooling at a relatively slow rate is continued below the ordering temperature of approximately 970°C., the nickel solid solution will form the very hard and brittle intermetallic phase $WNi_4$ which will be in equilibrium with the tungsten. The formation of this intermetallic phase embrittles the alloy and effectively reduces the ductility to essentially zero at room temperature. In order to prevent the formation of this embrittling intermetallic, the matrix phase of the nickel solid solution present above the ordering temperature is first stabilized in an inert atmosphere, such as argon or the like, at a temperature of about 970° to 1450°C. for a duration of about 1 to 4 hours and then rapidly quenched in water or any other suitable cooling liquid, such as iced brine or oil, to room temperature so as to maintain the matrix phase in a metastable, face-centered cubic, solid solution of tungsten in nickel. With the alloy of the present invention, tensile elongation amounting to about 3.1 to 16.5 percent at 25°C. was found to occur only when the aforementioned metastable phase was present with no detectable $WNi_4$. However, it has been found that if the alloy is reheated to or employed at a temperature of about 400°C. or above the $WNi_4$ phase will form in the alloy to reduce ductility. This $WNi_4$ phase once formed cannot be removed except by reheating the alloy to a temperature above the ordering temperature, stabilizing the alloy at this temperature to regain the $WNi_4$-free matrix phase, and then repeating the rapid quench used for initially forming the alloy. For example, with a tungsten—5 percent nickel alloy, a heat treatment after sintering for 1 hour at 1200°C. followed by a water quench produces an alloy having a compressive yield strength of 111 kpsi at 0.5 percent and a tensile elongation of 16.5 percent at 25°C. However, an alloy of similar composition after the water quenching step was heated for 3 hours at 800°C. and showed an increase in the compressive yield strength to 122 kpsi but exhibited zero tensile elongation at 25°C.

The effective concentration of the nickel in the tungsten-nickel alloy is between about 0.5 and about 10 weight percent since below about 0.5 percent there is insufficient nickel to form the necessary solid solution of tungsten in nickel, while above about 10 percent the capillary forces generated during the liquid phase sintering are overcome by forces of gravitation so as to create porosity or voids in the matrix during the sintering step.

To provide a more facile understanding of the alloy of the present invention examples relating to the fabrication of articles of various tungsten-nickel concentrations are set forth below.

EXAMPLE I

A mixture containing 665 grams of elemental tungsten and nickel powder of an average particle size of 9.0 microns and 4.8 microns, respectively, with a nickel concentration of 5.0 weight percent was blended for 1 hour. The blended powders were isostatically pressed for 1 minute at 30,000 psi into a cylindrical compact having a 0.425-inch diameter and an 8-inch length. The compact was sintered in a hydrogen atmosphere at 1520°C. for 2 hours. After the sintering operation, the alloy was heat treated for 1 hour at 1200°C. in an inert atmosphere, and water-quenched to room temperature. Analyses of the water-quenched, tensile-test blanks indicated a density of 18.25 g/cc. a 0.5 percent offset compressive yield strength of 104,600 psi, and 0.2 percent offset tensile yield strength of 91,000 psi, and a tensile elongation of 16.5 percent in 1 inch.

EXAMPLE II

In this example a 665-gram mixture containing 1.75 weight percent nickel and 98.25 weight percent tungsten was pressed, sintered, and quenched as in Example I. Tensile bars having a 1-inch gauge length were tested at 0.005-inch/inch/minute strain rate. The tests indicated a tensile strength of 104,900 psi and an elongation of 3.1 percent in 1 inch. Density measurements indicated a density of 18.84 g/cc for the alloy.

EXAMPLE III

In another example, a mixture of powder containing 98.00 weight percent tungsten and 2.00 weight percent nickel was processed in the manner described in Example I. Tensile bars having a 1-inch gauge length were tested at a strain rate of 0.005-inch/inch/minute. The tests indicated a tensile strength of 113,150 psi and an elongation of 5.12 percent in 1 inch. Density measurements indicated a density of 18.80 g/cc.

It will be seen that the present invention provides a tungsten-nickel alloy of a density in the range of 17.30 to 18.84 g/cc which possess a compressive yield strength of greater than 100,000 psi, and which is especially characterized by room temperature ductility in the range of 3.1 to 16.5 percent elongation in one inch. This ductility feature is due to the liquid phase sintering for forming a solid solution of tungsten in nickel with tungsten grains embedded therein and the rapid quenching of the heat treated alloy to a temperature below the ordering temperature to assure that the brittle intermetallic ($WNi_4$) phase is not formed in the alloy.

What is claimed is:

1. A method of preparing a tungsten-nickel alloy of a ductility characterized by a tensile elongation in the range of about 1.0 to about 20.0 percent in 1 inch at 25°C., comprising the steps of forming a powder mixture consisting of tungsten and about 0.5 to about 10 weight percent nickel, pressing the mixture into a compact, heating the compact in a hydrogen atmosphere to a temperature above 1510°C. to effect liquid-phase sintering of the powder, heating the compact in an inert atmosphere at a temperature above approximately 970°C. to stabilize the matrix phase, and thereafter quenching the compact to room temperature with sufficient rapidity for maintaining the matrix phase in a metastable, face-centered cubic, solid solution of tungsten in nickel while inhibiting the formation of the intermetallic $WNi_4$.

2. The method claimed in claim 1, wherein the temperature sufficient to effect the liquid sintering of the powder is in the range of 1510° to 1550°C., and wherein the matrix is stabilized at a temperature in the range of about 970° to 1450°C. for a duration in the range of about 1 to 4 hours.

3. A sintered tungsten-nickel article consisting essentially of about 0.5 to 10 weight percent nickel and the balance tungsten and characterized by a tensile strength of at least about 100,000 psi, a density in the range of 17.30 to 18.84 g/cc, a tensile elongation in the range of about 3.1 to 16.5 percent in 1 inch at 25°C., and a matrix phase in a metastable, face-centered cubic, solid solution of tungsten in nickel.

* * * * *